US006726294B1

(12) United States Patent
Muller et al.

(10) Patent No.: US 6,726,294 B1
(45) Date of Patent: Apr. 27, 2004

(54) CABINET LOCKING SYSTEM

(75) Inventors: Thomas Muller, Romanshorn (CH); Bruno Hasler, Arbon (CH)

(73) Assignee: Lista Europe Holding AG (CH)

( * ) Notice: Subject to any disclaimer, the term of this patent is extended or adjusted under 35 U.S.C. 154(b) by 0 days.

(21) Appl. No.: 09/674,582

(22) PCT Filed: Mar. 5, 1999

(86) PCT No.: PCT/CH00/00119

§ 371 (c)(1),
(2), (4) Date: Jan. 8, 2001

(87) PCT Pub. No.: WO00/53871

PCT Pub. Date: Sep. 14, 2000

(30) Foreign Application Priority Data

Mar. 5, 1999 (CH) ..... 409/99

(51) Int. Cl.[7] ..... E05B 65/46
(52) U.S. Cl. ..... 312/215; 312/221; 312/219
(58) Field of Search ..... 312/216, 217, 312/221, 215, 222, 219

(56) References Cited

U.S. PATENT DOCUMENTS 5,172,967 A 12/1992 Pipe
5,225,825 A 7/1993 Warren
5,605,388 A 2/1997 Laakso

FOREIGN PATENT DOCUMENTS

DE 8802 655 8/1988
DE 4101744 7/1992
EP 0 497040 A1 8/1992

*Primary Examiner*—Lanna Mai
*Assistant Examiner*—Jerry Anderson
(74) *Attorney, Agent, or Firm*—Cesari and McKenna, LLP

(57) ABSTRACT

A cabinet locking system includes at least one cabinet having a housing and a plurality of separately openable compartments in the housing. The system has an interlocking device locking the compartments, that device including separate switchable locking devices mounted in the housing and assigned to the compartments as well as an access authorization device into which identification codes corresponding to the compartments may be entered. An electronic processing unit that is connected to the interlocking device and the access authorization device controls the locking devices in accordance with codes entered into the access authorization device so that by entering selected codes into that device, corresponding ones of the compartments are unlocked. The system also includes an interlock responsive to the opening of one unlocked compartment for preventing the opening of any other unlocked compartment.

8 Claims, 8 Drawing Sheets

CABINET LOCKING SYSTEM

CROSS REFERENCE TO RELATED APPLICATIONS—NOT APPLICABLE

BACKGROUND OF THE INVENTION (1) Field of the Invention

The invention relates to a cabinet locking system, which has at least one cabinet and access authorization means, with which specific compartments of the cabinet can be released to be opened. The invention also relates to cabinets suitable for such a system.

Cabinets and cabinet systems are used in many sectors in trade and industry, for example as stationary or mobile tool cabinets in the industrial production sector or in the workshop sector. Since heavy tools or workpieces often have to be kept in such cabinets, tilting of the cabinets when drawers are opened must be avoided. It has therefore been known for a long time to provide cabinets of this type with an individual pull-out safeguard. This is intended to ensure that a plurality of drawers cannot be opened at the same time, but only one drawer, in order in this way to reduce the tilting moment resulting from the pulled-out drawer.

(2) Description of Related Art

It has been shown that, in some areas of application, security requirements have to be met and are not met by existing cabinets. Thus, for example, the intention is to prevent any persons from having access to security-sensitive parts or tools which are stored in cabinets. This would intrinsically be achieved simply by these elements being locked in compartments in the cabinets. In order to access these, the corresponding compartments would have to be unlocked and locked continually, however, which would disrupt the working sequence considerably. In addition, each compartment would have to be provided with its own lock and key, which increases the outlay on construction. In addition, such a solution would also entail relatively large organizational outlay, since it would be necessary to monitor which persons are given keys for which drawers. In the event of the access authorizations, the return of a large number of keys would have to be monitored would have to be organized.

The invention is therefore based on the object of providing a cabinet system, in particular for the production and workshop sectors, in which it is possible to ensure that only authorized persons have access to drawers or other cabinet compartments and, in spite of these security measures, the working sequences are essentially not impaired.

SUMMARY OF THE INVENTION

According to the invention, the object is achieved by a cabinet locking system according to the main claims.

Systems according to the invention should therefore have at least one cabinet, preferably a number of cabinets, in which compartments preferably constructed as drawers, in particular in different cabinets, can be allocated uniquely to one user or one use group. The allocation is made via an electronic processing unit, with which each locking device of the compartments is assigned to a specific code and therefore to a specific user group. In order that the allocation can be selected freely and changed, this is preferably done by software implemented in the electronic processing unit.

The electronic processing unit should be connected to the individual locking devices of the interlocking device and the access authorization device and switched in such a way that locking devices are released as soon as a code associated with this group is input by the access authorization device or is detected as being applicable. In order that the desired drawers can be released, appropriate switching signals have to be sent to the respective locking devices.

A cabinet system according to the invention can include virtually any number of cabinets, drawers, groups and users. It can therefore be used to regulate the access authorization of all the cabinets, in particular all the security-sensitive cabinets, or other lockable storage means, in a production shop, workshop or the like. However, it can likewise be used to administer and regulate the access authorization of only one cabinet, for example a tool cabinet that is mobile and provided with drawers.

In a preferred embodiment, the cabinet system is based on a drawer cabinet described in U.S. Pat. No. 5,605,388. This has a central mechanical interlocking device which is provided with an interlocking profile in which each drawer engages with a tongue. The tongue serves on the one hand to lock the drawer against impermissible pulling out of the drawer when the cabinet is locked via a central lock. On the other hand, the tongue is also a constituent part of an individual pull-out safeguard. The latter ensures that no further drawers can be pulled out as soon as the action of pulling out a first drawer has been started. In combination with the cabinet system according to the invention, it is therefore always possible for only one drawer in a cabinet to be pulled out at specific points in time. The invention supplements the cabinet to the effect that, in principle, only those drawers can be pulled out which belong to one or more groups of drawers with regard to which an authorization means or code has been detected by the access authorization vice, and therefore have been released to be pulled out. In order to keep the complications on construction as low as possible, the separate locking devices provided to distribute the access authorization for each drawer can also be constituent parts of the individual pull-out safeguard at the same time.

An advantageous and constructionally uncomplicated locking device can be implemented by the locking of a drawer being carried out via a spring-loaded slide which, in order to be released, is pushed out of its locking position by a reciprocating magnet. This release is always carried out in all the drawers which belong to a specific group in the sense of the present invention. These drawers are therefore in principle ready to be pulled out as soon as the electronic processing unit has detected the code input into the access authorization device as being applicable and has emitted a corresponding release signal. Only the individual pull-out safeguard prevents more than one of these drawers being pulled out at the same time.

In a further preferred embodiment, it is possible to ensure that, in the event of a power failure, all the drawers are secured against any access. Because of the power failure, firstly the reciprocating magnets belonging to the locking devices lose their effect, by which means all the slides in a cabinet are transferred into a release position by the springs acting on them in each case. However, locking the drawers is then carried out centrally by means of the interlocking profile, which is operatively connected to a power-fail safeguard. In one embodiment, provision can be made for this purpose for a lever to act on the central interlocking profile, said lever being pivoted by a spring from a release position into a locking position. The spring acts only in the event of a power failure, since its spring force is otherwise counteracted by a further reciprocating magnet belonging to the power-fail safeguard. Because of the spring in the power-fail safeguard, the interlocking profile is transferred into its locking position and locked in the latter. All the drawers are therefore secured against being pulled out, irrespective of whether they were previously in an "open" or "closed" position on the basis of the locking devices that can be switched via the access authorization device. In order to have access to the drawers again in spite of a power failure continuing, provision can be made for the drawers to be capable of being opened again by using a mechanical lock system, which preferably likewise acts on the interlocking profile.

In a further preferred embodiment, the power-fail safeguard can have a mains-independent emergency power supply. Using a sensor in the power-fail safeguard, it can be determined whether the interlocking profile—or any other interlocking device in the drawers—is located in the locking or release position. With the aid of a suitable actuating means, for example two reciprocating magnets acting in opposite directions, the interlocking profile can be actuated even during a power failure. In conjunction with the sensor, provision can in particular be made for the interlocking profile always to be transferred into its locking position during a power failure if it should be located in the release position for any reason.

Further preferred configurations of the invention emerge from the dependent claims.

BRIEF DESCRIPTION OF THE DRAWINGS

The invention will be explained in more detail using an exemplary embodiment illustrated schematically in the Figures, in which:

FIGS. 5A, 5B, 5C show a view from below of part of the interlocking device in three different position as a drawer is being pushed in;

DETAILED DESCRIPTION OF AN INVENTION

Figure 1:
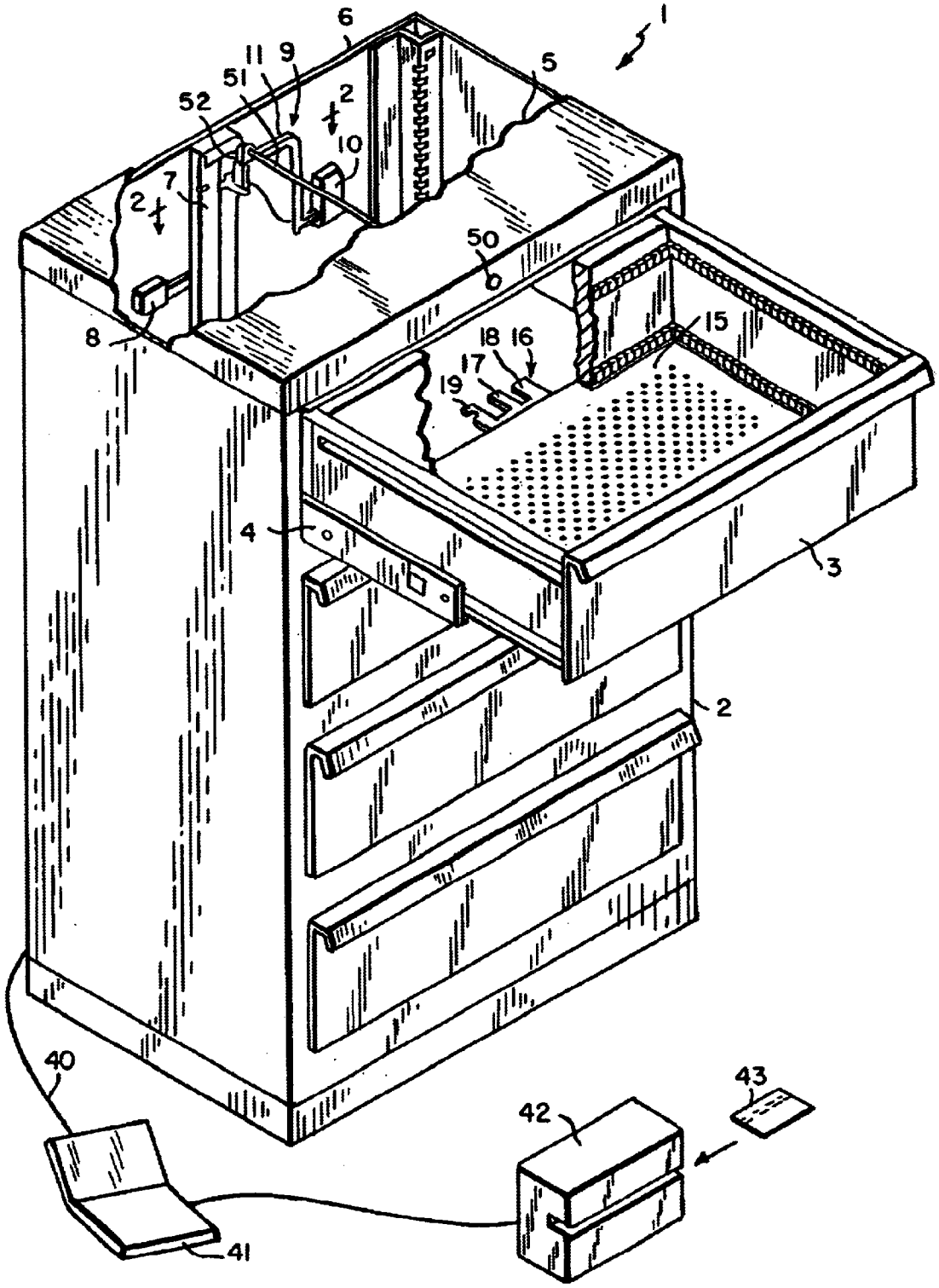
FIG. 1 shows a drawer cabinet according to the invention in a perspective illustration.

FIG. 1 shows a drawer cabinet 1 of a cabinet locking system according to the invention. The drawer cabinet has a housing 2, in which a number of drawers 3 are mounted via rollers (not illustrated) on telescopic runners 4 so that they can be pulled in and out. As can be seen on the basis of a partly broken-open illustration of a top plate 5 of the housing 2, on a rear wall surface 6 of the drawer cabinet 1 there is fastened an interlocking profile 7, which belongs to an interlocking device of the cabinet locking system. The interlocking device is constructed as a central interlock.

Figure 2:
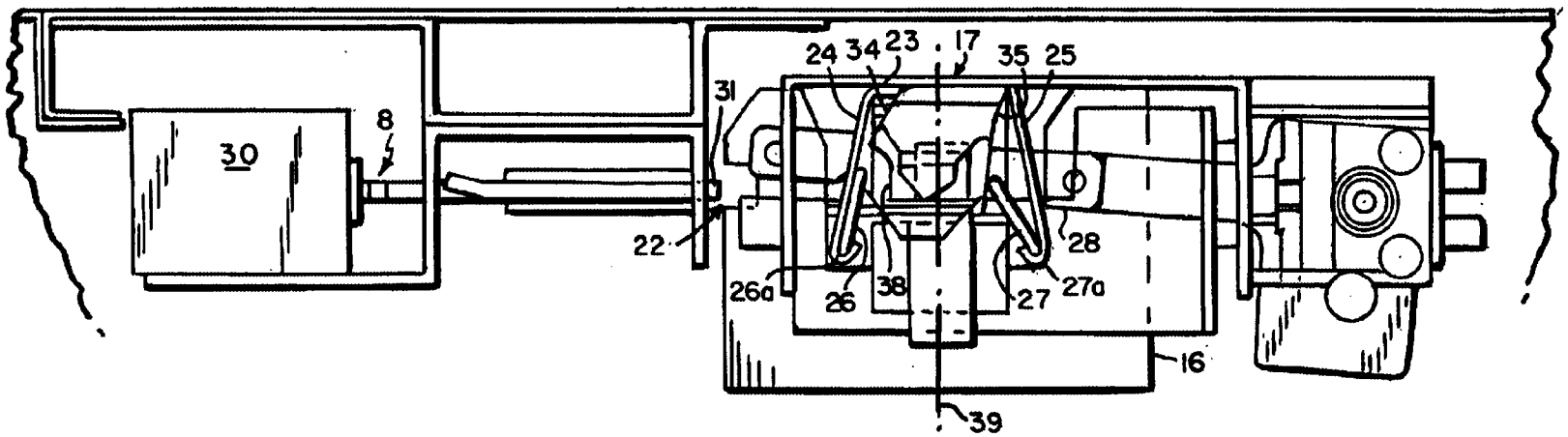
FIG. 2 shows a plan view of the interlocking device shown in FIG. 1 along the line II—II.
Figure 3:
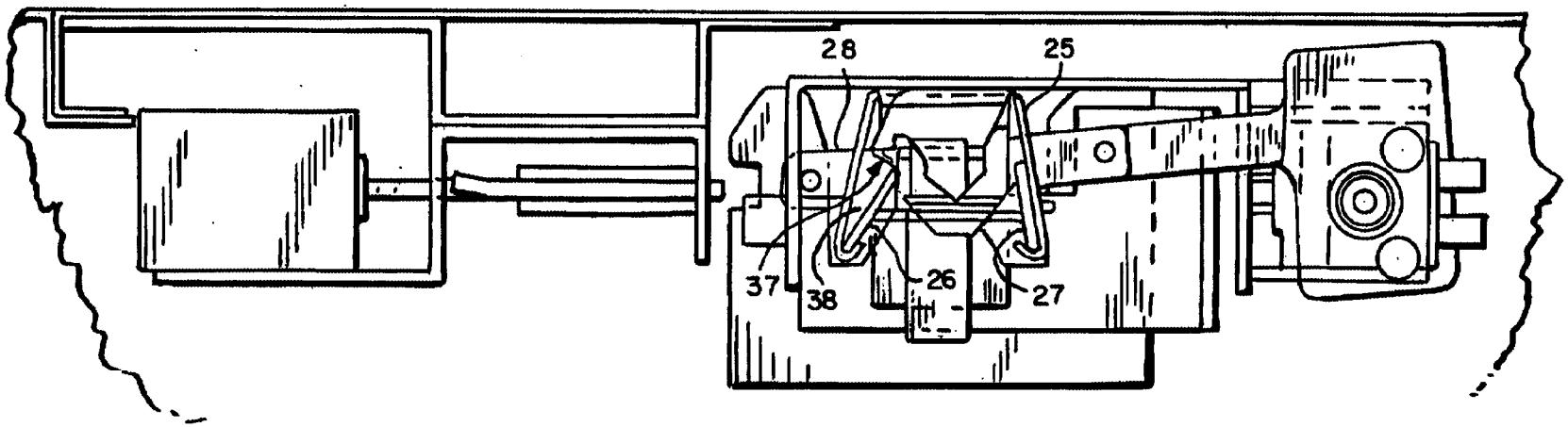
FIG. 3 shows an illustration according to FIG. 2, in which parts of the interlocking device are located in a different position.
Figure 4:
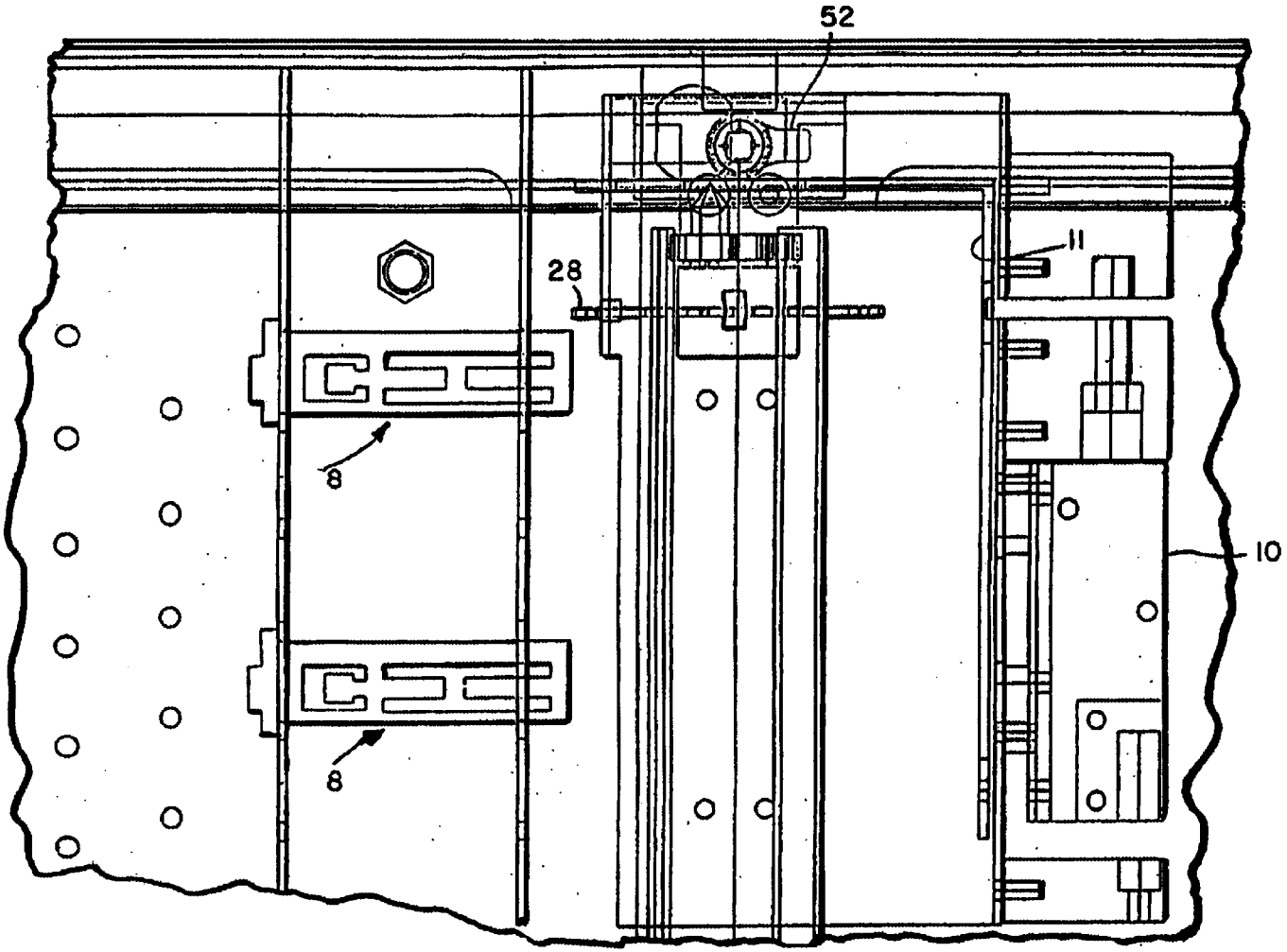
FIG. 4 shows a front view of part of the rear of the wall of the cabinet according to the invention.

In the illustration of FIG. 1, one of the locking devices 8 also illustrated in FIGS. 2, 3 and 4 and belonging to the drawer cabinet 1 is shown. Each of these locking devices is assigned to only one drawer 3. The locking devices 8 interact with the interlocking profile 7 in a manner to be explained in more detail below. Shown on another side of the interlocking profile 7, in very schematic form, is a power-fail safeguard 9, which comprises a reciprocating magnet 10 loaded by a spring and an angled lever 11 attached thereto. The power-fail safeguard interacts with the interlocking profile in a manner to be explained in more detail below.

Each drawer 3 has, on an edge of a bottom surface 15 that is oriented towards the rear wall surface 6 of the housing 2 and belongs to each drawer, a fitting 16. As emerges, inter alia, from FIG. 1, a tongue 17 is formed on the fitting 16 and is provided to engage in the interlocking profile 7. The tongues 17 and the interlocking profile 7 are constituent parts of an individual pull-out safeguard, as described in more detail in U.S. Pat. No. 5,605,388 and EP 0 755 478 AI. The construction and functional scope described in each case in that document of these individual pull-out safeguards is thus incorporated completely by reference and declared to be content of this patent application as well. The tongue 17 is in each case surrounded by a fork of the fitting. Between the tongue and the two legs 18, 19 of the fork, a gap is formed in each case. One of the two forks 18, 19 is provided with a slot 22.

FIG. 2 now shows how the interlocking profile 7 has three legs 23, 24, 25 belonging to a rail. Each side of a base leg 23 is adjoined by a side leg 24, 25, which in each case encloses an obtuse angle with the base leg 23. One free end of each side leg 24, 25 is bent over. In the bent-over ends, a switching strip 26, 27 is mounted in each case by one side edge 26*a*, 27*a*, is aligned essentially parallel to the rail and is able to execute pivoting movements about its side edges 26*a*, 27*a*. The two switching strips 26, 27 are coupled to each other via two dogs 28 which are each arranged in the area of one of the ends of the rail, in which area in each case the side edges 26*b*, 27*b* of the switching strips 26, 27 are arranged. The dogs 28 are guided in the side legs 24, 25 in planes which are aligned essentially orthogonally to the longitudinal extent of the interlocking profile.

On one side of the interlocking profile 7 there are locking devices 8 which are arranged in an approximately vertical row (FIG. 4). Each of these locking devices 8 is assigned to one drawer 3 in each case and has an electrically actuated reciprocating magnet 30 (FIG. 2), on which a slide 31 is arranged. The slide 31 can be displaced by the reciprocating magnets 30 in an essentially horizontal movement in the direction of the interlocking profile 7. In addition, each slide 31 is loaded by a force in the direction away from the fitting 16 by a spring (not illustrated). Since the spring force is lower than the force originating from the respective reciprocating magnets 30, the slide 31 can be displaced counter to the spring force in the direction of the fitting 16. By this means, the slide 31 passes into the slot in the fitting 16 and locks the respective drawer 3 against being pulled out. In order to release the drawer 3, the respective reciprocating magnet 30 must be actuated electrically, by which means the spring (not illustrated) pushes the slide 31 out of the slot 22.

Figure 5A:
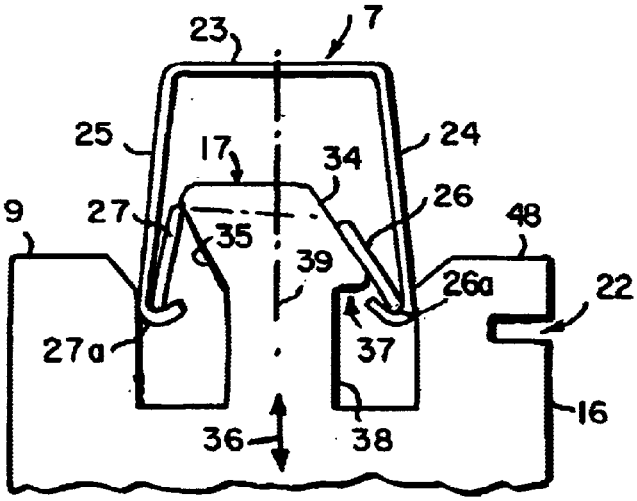

The tongue 17, which is illustrated inter alia in FIGS. 2 and 5A, has two sections 34, 35 of side edges which extend essentially in parallel. These two sections 34, 35 are bent over with respect to a push-in and pull-out direction (arrow 36) which extends essentially orthogonally with respect to the longitudinal extent of the interlocking profile 7. The side edge 34 located on the side of the first switching strip 26 has an undercut 37, which merges into a section 38 of this side edge of the tongue 17, which section extends essentially parallel to the push-in and pull-out direction 36. The side edge 35 of the tongue located opposite the second switching strip 27 is, by contrast, bent over over its entire length and, starting from the free end of the tongue, extends toward a center line 39 of the tongue and of the interlocking profile 7.

The drawer cabinet 1 is provided with an electronic processing unit (not illustrated). This electronic processing unit can in turn be connected, via an interface and an electric line 40, to a PC 41 (FIG. 1), in order to program the unit. Connected in turn to the PC 41 is a magnetic card reader 42 as a constituent part of an access authorization device. Using the reader 42, magnetic codes contained on magnetic cards 43 can be read. Of course, it would also be possible to use virtually any desired different code carrier and any desired code reader, such as inductive devices, chip card readers or else locks with associated keys. Likewise, the users can also be given only a numeric code, which has to be input by them.

Loaded into the processing unit is a program with which the drawers 3 of the cabinet 1 illustrated—and drawers of any desired further cabinets belonging to the system—can be combined into various groups. These groups can therefore comprise any desired number of drawers 3. In addition, the program offers the possibility of changing the composition of the groups at any time, that is to say which drawers 3 are allocated to which group. The functional scope of the program ultimately also includes the facility for each group to be assigned a specific authorization means, a specific magnetic code in the present exemplary embodiment, which can be given out to every member of a user group In order to be able to make access to a specific group of drawers 3, in accordance with this composition of the groups, a magnetic card 43 which contains the appropriate code assigned to this group has to be entered into the card reader 42. After this reading operation has been concluded and the code has been transmitted to the electronic processing unit, the latter outputs a switching signal to the cabinet 1, as a result of which all the reciprocating magnets 30 in the drawers 3 in this group are activated. The respective spring of the reciprocating magnets 30 therefore moves the corresponding slide 31 of each drawer 3 in this group out of the slot 22 in the fitting. The drawers 3 are therefore intrinsically ready to be pulled out. By contrast, all the other drawers continue to be locked by the slide belonging to their locking device against being pulled out, since they do not belong to the released group.

In order that drawers can actually be pulled out, the central interlock also has to be released by the power-fail safeguard. The latter has, on the side of the side leg 25, the further reciprocating magnet 10 belonging to the central interlock (FIGS. 1 and 4). Said magnet acts on the upper dog 28 via an angled lever 11. As a result of currents being applied, the magnet 10 executes a stroke and is brought into an end position in which it displaces the angled lever vertically downward parallel to the interlocking profile. By this means, cams not illustrated in the figures release the upper dog 28. The dog 28 is now able to move in a plane which extends essentially orthogonally to the longitudinal extent of the interlocking profile 7 (release position of the power-fail safeguard). If the reciprocating magnet 10 is de-energized, then the spring pushes the magnet and the angled lever 11 attached thereto vertically upward again, as a result of which one of the cams engages in a recess in the dog and locks the latter against movement (locking position of the power-fail safeguard).

As a result of the release of the central interlock, the switching strips 26, 27 are also transferred into the end position shown in FIG. 2, which corresponds to their release position. In this end position of the switching strips 26, 27, the central interlock is open, that is to say it releases all the drawers 3 in the cabinet 1 to be pulled out, provided their locking devices 8 permit this. In the release position, the first switching strip rests on the side leg 24 adjacent to the locking devices, while the switching strip 27 is pivoted with its free edge 27*a* away from the side leg 25 toward the tongue 17 and rests on the side edge 35 of the latter. From FIG. 3, it emerges that the second switching strip 27 rests on the side leg 25 when in its locking position. In its locking position, the first switching strip is pivoted behind the undercut 37 of the tongue and rests on the section 38 of the side edge of the tongue 17. In the locking position, it is therefore possible for the drawer to be moved at most by a few millimeters, until the first switching strip comes into contact with an undercut edge of the tongue, and further pulling out of the respective drawer is stopped.

Because of the release and locking position of the switching strips 26, 27 belonging to the individual pull-out safeguard, only one drawer can be pushed out in each case. To this end, the switching strips 26, 27 interact as follows with the tongues of the drawers: if a drawer has been pulled out, then the switching strips are located in the locking position shown in FIG. 5A. Since the first switching strip 26 has been pivoted with its free side edge toward the center line of the interlocking profile and behind the undercuts of the tongues 17, it locks the drawers pushed in against being pulled out.

Figure 5B:
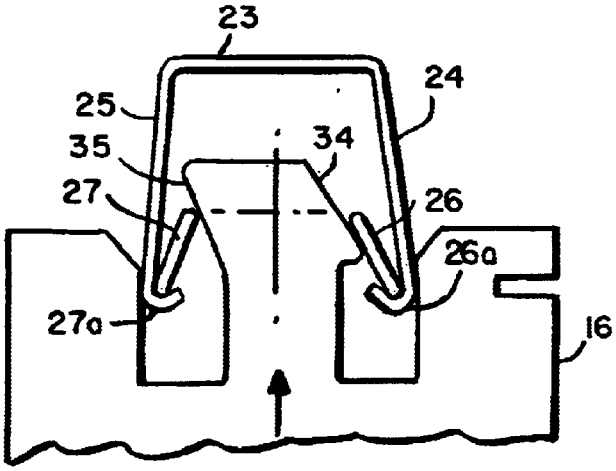
Figure 5C:
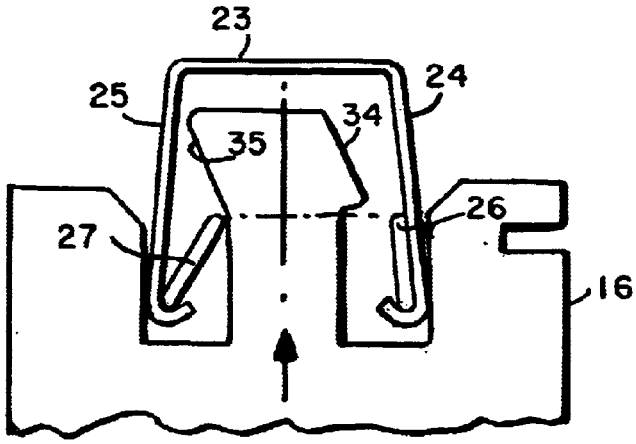

When the pulled-out drawer 3 is pushed in, the tongue 17 is pushed in between the two turned-over ends of the two side legs 24, 25 in the direction of the base leg 23 of the interlocking profile 7. The tongue 17 then encounters the two switching strips 26, 27, whose spacing from each other approximately corresponds to a width of the tongue 17 (in relation to a direction transverse with respect to the push-in and pull-out direction). The two sections 34, 35 of the side edges therefore come into contact with the two switching strips 26, 27. Since the sections 34, 35 extend obliquely with respect to the push-in direction, the two switching strips 26, 27 are pivoted toward the side leg 24. In particular, the oblique course of the section 34 has the effect that the switching strips are firstly pivoted counter to the force of a leaf spring (not illustrated) (FIG. 5B). In the course of this pivoting movement, a dead point of the leaf spring is overcome, as a result of which the spring force then acts in the pivoting direction and the switching strips are transferred into their release position (FIG. 5C). In this position, the drawer is then pushed in completely. Since the two switching strips are then located in their release position, any desired drawer in the released group can be pulled out.

Figure 5D:
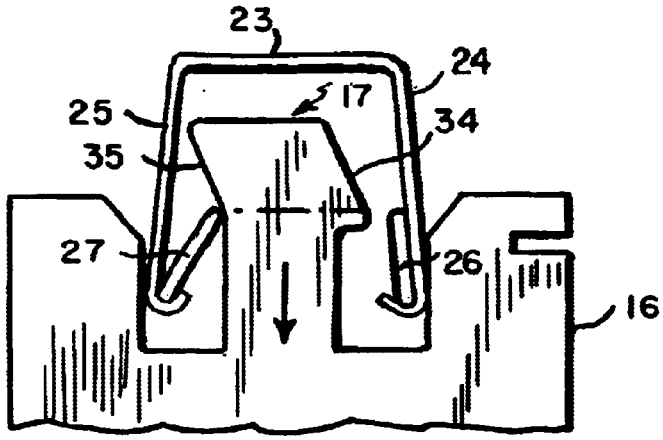
FIGS. 5D, 5E, 5F show a view from below of part of the interlocking device in three different positions as a drawer is being pulled out.
Figure 5E:
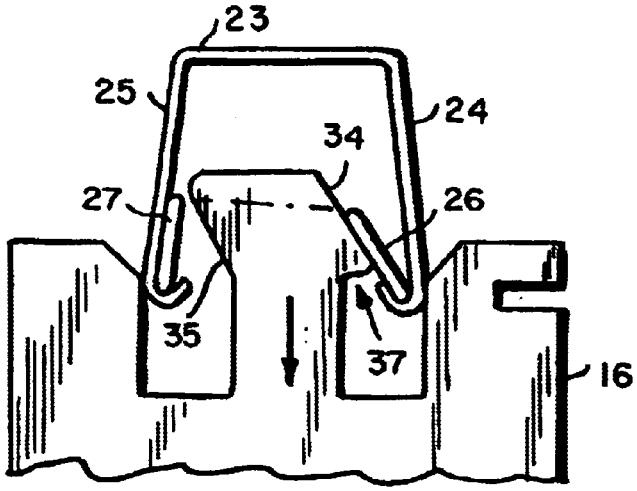
Figure 5F:
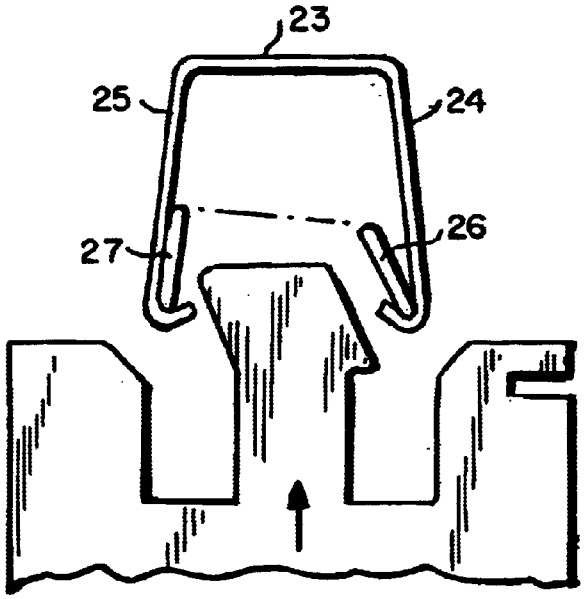

As a result of a drawer 3 being pulled out according to FIGS. 5D, 5E, 5F, the two switching strips 26, 27 are pivoted from their release position into their locking position again. For this purpose, first of all the switching strip 27 rests on the side edge 35 of the tongue 17 (FIG. 5D), and then slides along the latter (FIG. 5E). By this means, the second switching strip 27 is pivoted in the direction of the leg 25. Because of the coupling, in this case the second switching strip takes the first switching strip 26 with it, as a result of which the first switching strip 26 is pivoted in the direction of the center line 39, until it assumes its locking position according to FIG. 5F. In this case, too, the leaf spring initially counters this pivoting movement. Beginning approximately at the position illustrated in FIG. 5E, a dead point of the spring is overcome and its spring force then acts in the direction of the pivoting movement toward the side leg 25.

In the event of an attempt to pull out a further drawer, the undercut 37 of the tongue 17 of this drawer would strike the first switching strip 26. None of the further drawers can therefore be pulled out until the drawer that has already been pulled out is pushed in again and therefore the individual pull-out safeguard is released again. In order to transfer the individual pull-out safeguard from its locking position into its release position and back again, it is therefore necessary to use a tongue 17 belonging to a drawer 3 to pivot the switching strips 26, 27 in two opposite directions.

In the event of a power failure, the reciprocating magnets 30 of the locking devices 8 of the individual drawers 3 also become de-energized. The springs of the locking devices 8 therefore press all the slides 31, that is to say even those slides 31 which belong to different groups than the drawers already released, into their release position (FIGS. 1 and 4). Since even the reciprocating magnet 10 of the power-fail safeguard is de-energized, its spring presses against the angled lever 11, as a result of which the latter is pushed vertically upward. Because of this movement of the angled lever 11, the switching strips 26, 27 are transferred into their locking position according to FIG. 3, if they are not already located in this position in any case. In addition, one of the cams is subsequently pushed into one of the two recesses in the upper dog 28, as a result of which the latter is fixed against movement and the interlocking device is fixed in its locking position. If a drawer is pulled out during the power failure, it is nevertheless possible for this to be pushed in again counter to a resilient resistance from the two metallic switching strips. For this purpose, the switching strips have to be pressed in the direction of their release position using the tongue 17 of this drawer, and the drawer has to be pushed in completely. As soon as the undercut is located behind the first switching strip 26, both switching strips 26, 27 spring back into their locking position, as a result of which all the drawers are then secured against unauthorized pulling out.

The power-fail safeguard may be released again via a central interlock 50 (FIGS. 1 and 4). To this end, a switching rod 51 can be actuated by using a key and, via an eccentric 52, presses the angled lever 11 downward again counter to the lifting direction of the spring. The effect of this is that the cam releases the dog 28 again and the drawers 3 are again ready to be pulled out. Since, however, all the drawers can now be pulled out, it should be ensured that this releasing of the power-fail safeguard can be carried out only by trusted personnel.

Figure 6:
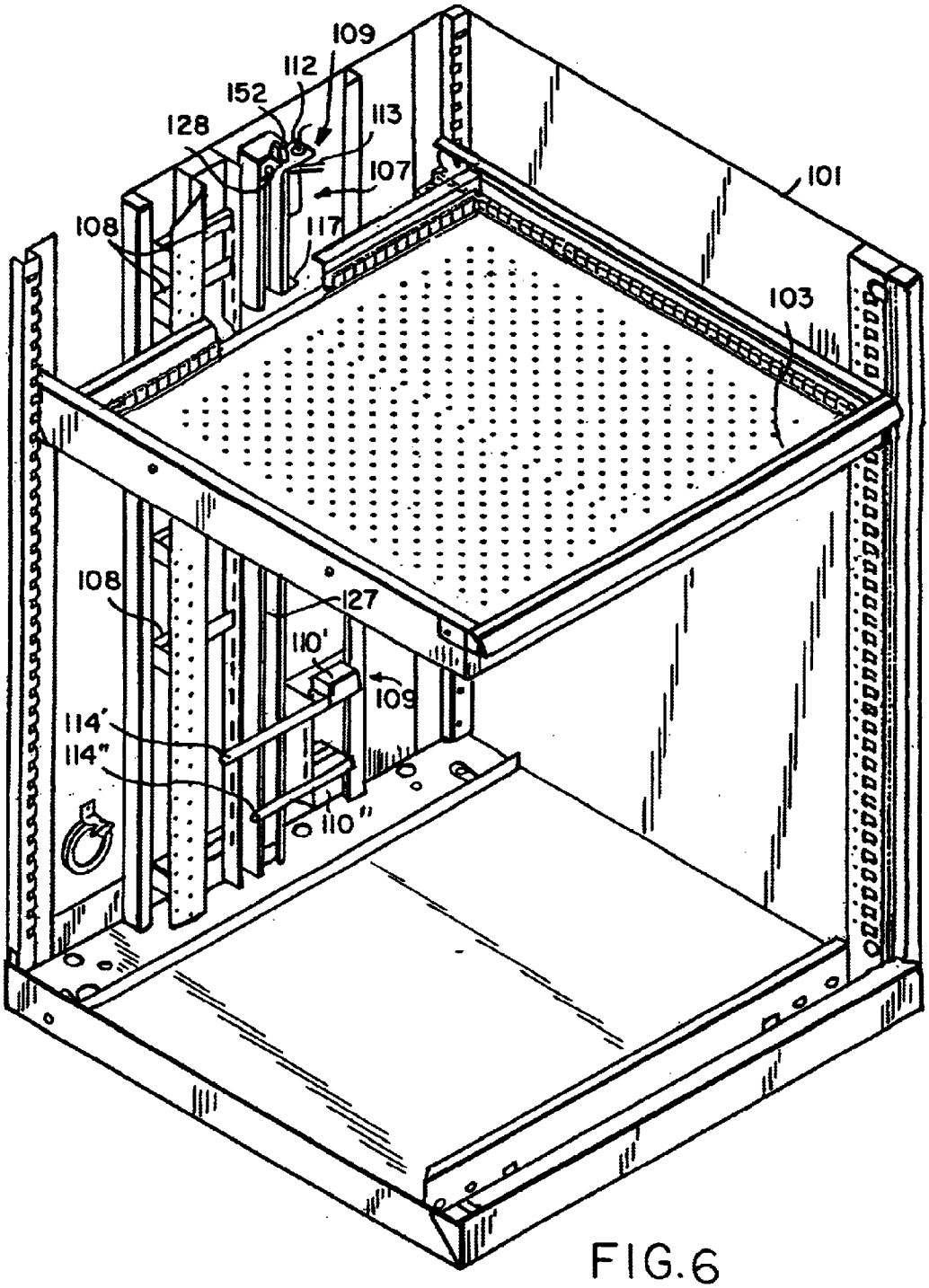
FIG. 6 shows a sectional perspective illustration of part of a further drawer cabinet according to the invention.
Figure 7:
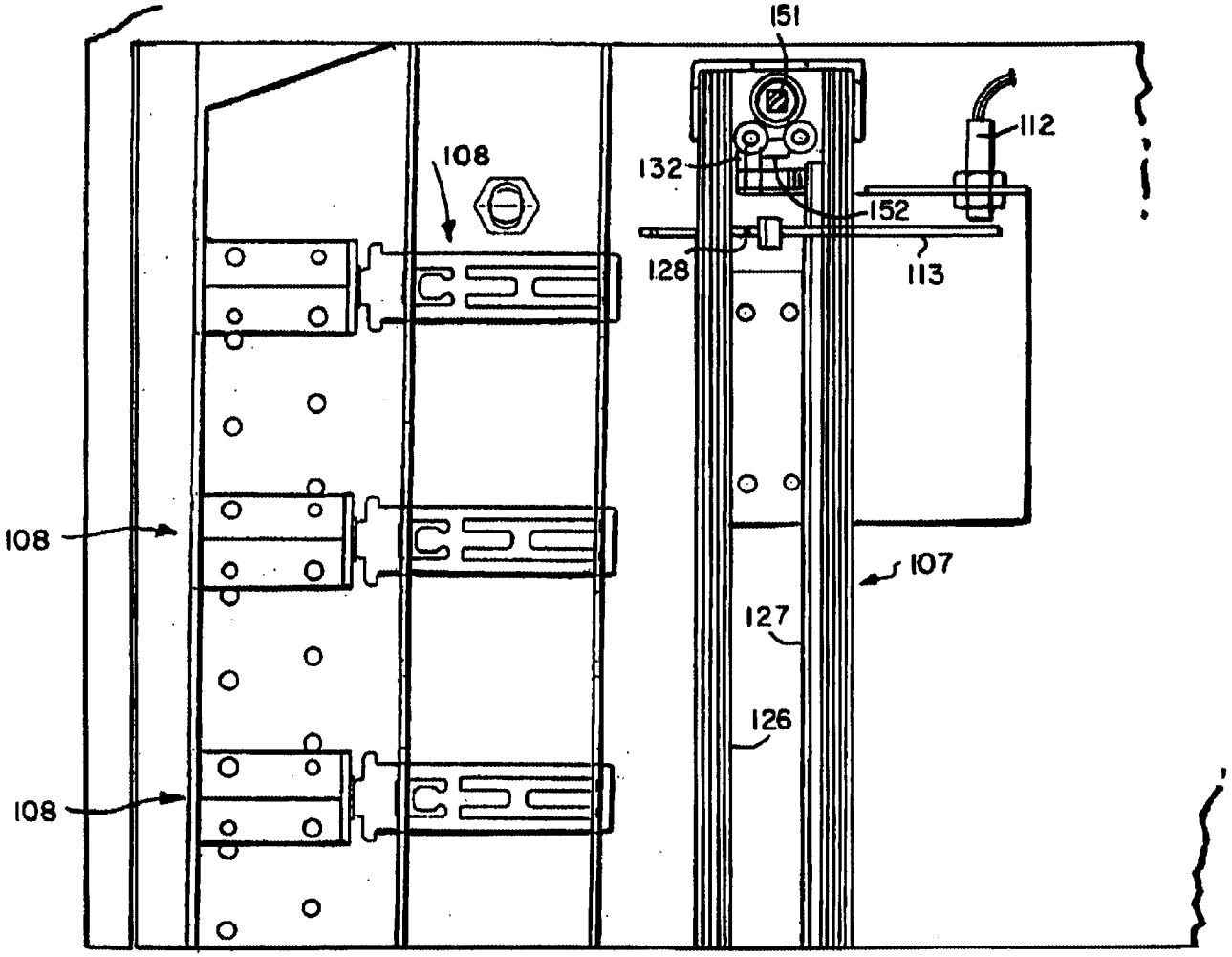
FIG. 7 shows an elevation of part of an inner side of the rear wall of the drawer cabinet shown in FIG. 6.

FIGS. 6 and 7 show a further drawer cabinet 101 according to the invention and belonging to a cabinet locking system which is essentially the same as the basic construction of the drawer cabinet 1 shown in FIGS. 1 to 5F. In the following text, therefore, only the differences with respect to the drawer cabinet 1 shown previously will be discussed.

Differing from the drawer cabinet 1, the drawer cabinet 101 has an inductive sensor 112 in the area of the upper end of the interlocking profile 107 of its central interlock on the side opposite the reciprocating magnet 110. Located underneath the inductive sensor 112 is a pivottable flag 113, which is connected to the dog 128 by a hinge. Depending on the position of the two switching strips 126, 127 (cf. also FIG. 7) of the central interlock, the flag 113 is located directly underneath the inductive sensor 112—and therefore in the detection range of the sensor—or alongside it, as illustrated in FIG. 6. In the exemplary embodiment shown, provision is made for the flag 113 to be located under the flag in the release position of the central interlock and alongside it in the locking position.

Arranged between the two switching strips 126, 127, on the dog 128, is a switching pin 132, which interacts with an eccentric 152 on the switching rod 151, which is shown in section. The switching rod 151 can be actuated by a cylindrical lock arranged on a front side (not shown) of the drawer cabinet.

On the same side as the inductive sensor 112, in the area of the lower end of the interlock profile 107, there are two reciprocating magnets 10' and 10", which are each connected to a slide 114', 114". Each of the slides 114', 114" has a dog, which engages between the two switching strips. In the event of actuation of one of the two single-acting reciprocating magnets 110', 110", the switching strips 126, 127 can be moved from one end position into a second end position by means of one of the dogs. The switching strips 126, 127 can therefore be transferred into their locking position by the upper reciprocating magnet 110' and into their release position by the lower magnet 110". The respective other reciprocating magnet is then de-energized and is carried along via its dog during the respective movement.

The inductive sensor 112 and the two reciprocating magnets belong to a power-fail safeguard 109, which is provided with its own, mains-independent, non-illustrated power supply—namely a buffer accumulator. The power-fail safeguard can achieve the situation where, even in the event of a power failure, unauthorized access to drawers 103 is not possible.

On the basis of the position of the flag 113, the inductive sensor 112 can be used to determine whether the switching strips 126, 127 are in the locking or in the release position. The inductive sensor 112 transmits a corresponding signal to a control system which is not illustrated but is installed in the drawer cabinet. In the event of a power failure, the components of the failure safeguard—and therefore also the control system—are supplied with power by the buffer accumulator.

Because of differing circumstances, the switching strips 126, 127 may be located in their release position in the event of a power failure, for example because they were already arranged in this position before the power failure. However, after the power failure has occurred, they can be transferred into this position by means of one or more drawers 103 being pushed in only after the power failure. If, then during a power failure, the inductive sensor 11 determines on the basis of the position of the flag 113 that the switching strips 126, 127 are located in the release position, the upper reciprocating magnet 110' is energized (by the buffer accumulator). This magnet therefore executes a stroke, as a result of which its dog transfers the switching strips 126, 127 into their locking position. All the drawers 103 in the drawer cabinet are therefore secured against unauthorized access, although the reciprocating magnets of the locking devices 108 assigned to the individual drawers 103 are then de-energized.

In order, nevertheless, to be able to use the drawer cabinet 101 during a power failure, provision can be made for the switching strips 126, 127 to be capable of being actuated via the central mechanical lock. Said switching strips can be transferred from their locking position into their release position with the aid of the lock. By means of the lock, on the basis of a rotation of the eccentric 152 via the switching pin 132 and the dog 128, the switching strips can be pushed from their locking position into the release position.

In this state, all the drawers in the drawer cabinet are accessible, without any restriction to specific user groups. Keys for the central interlock should therefore be allocated only to selected personnel.

After the power supply has been re-established by the mains, in order to transfer the switching strips 126, 127 into their release position, the second reciprocating magnet 110" is energized by the control system, as a result of which said magnet executes a corresponding stroke. Via the switching strip 114' and its dog, during this movement the first reciprocating magnet, which is then de-energized, is carried along. In addition, the control system then switches to "locking" all the locking devices 108 belonging to those drawers 103 which had assumed this position before the power failure. Of course, the other locking devices release their respectively associated drawer.

In a further embodiment—not illustrated—means can be provided by means of which a power failure cannot take place at all. It is thus possible, for example, for the cabinet locking system according to the invention to have an emergency power unit which, in the event of failure of the mains power, ensures an uninterrupted power supply to the overall locking system.

What is claimed is:

1. A drawer cabinet comprising a housing;

a plurality of mutually separated pull-out drawers arranged in the housing;

an interlocking device for separately locking and unlocking at least some of the drawers;

an access authorization device into which identification codes corresponding to different groups of said drawers may be entered;

an electric processing unit connected to the interlocking device and the access authorization device for controlling the interlocking device in accordance with the identification codes entered into the access authorization device so that when one of the identification codes is entered into the access authorization device, the drawers belonging in the corresponding group are unlocked by the interlocking device, and said interlocking device including individual pull-out safeguard means which allow only one unlocked drawer to be opened at any one time.

2. The cabinet as defined in claim 1, wherein the safeguard means include means responsive to the opening of any one unlocked drawer for preventing the opening of any other unlocked drawer.

3. The cabinet as defined in claim 1 or 2 and further including means for locking at least some of the drawers in the event of a power failure.

4. The cabinet as defined in claim 1 or 2 wherein said safeguard means comprise two switching strips that act on all the drawers and can be transferred, by one drawer in the cabinet, from a locking position, in which it locks the drawers against being pulled out, into a release position in which one drawer can be pulled out.

5. The cabinet as defined in claim 1 or 2 wherein said safeguard means act on the interlocking device.

6. A cabinet locking system comprising at least one cabinet including a housing and a plurality of mutually separated openable and closable compartments in the housing, a plurality of said compartments of one or more cabinets being combined into at least one group;

an interlocking device for locking and unlocking the compartments, said interlocking device including separate switchable locking devices mounted in the housing and assigned to said compartments;

an access authorization device into which identification codes corresponding to said compartments are entered, a specific identification code being allocated to said at least one group;

an electronic processing unit connected to the interlocking device and the access authorization device for controlling the locking devices in accordance with identification codes entered into the access authorization device so that when said specific authorization code is entered into the access authorization device, the compartments belonging to said at least one group are unlocked;

means responsive to the opening of one unlocked compartment for preventing the opening of any other unlocked compartment, and means for selecting and changing the allocation of said compartments to said at least one group.

7. A cabinet locking system comprising at least one cabinet including a housing and a plurality of mutually separated openable and closable compartments in the housing, a plurality of said compartments of one or more cabinets being combined into at least one group;

an interlocking device for locking and unlocking the compartments, said interlocking device including separate switchable locking devices mounted in the housing and assigned to said compartments;

an access authorization device into which identification codes corresponding to said compartments are entered, a specific identification code being allocated to said at least one group;

an electronic processing unit connected to the interlocking device and the access authorization device for controlling the locking devices in accordance with identification codes entered into the access authorization device so that when said specific authorization code is entered into the access authorization device, the compartments belonging to said at least one group are unlocked;

means responsive to the opening of one unlocked compartment for preventing the opening of any other unlocked compartment, and means for selecting and changing the allocation of one or more groups of compartments to selected identification codes.

8. A cabinet locking system comprising at least one cabinet including a housing and a plurality of mutually separated openable and closable compartments in the housing, a plurality of said compartments of one or more cabinets being combined into at least one group;

an interlocking device for locking and unlocking the compartments, said interlocking device including separate switchable locking devices mounted in the housing and assigned to said compartments;

an access authorization device into which identification codes corresponding to said compartments are entered, a specific identification code being allocated to said at least one group;

an electronic processing unit connected to the interlocking device and the access authorization device for controlling the locking devices in accordance with identification codes entered into the access authorization device so that when said specific authorization code is entered into the access authorization device, the compartments belonging to said at least one group are unlocked;

means responsive to the opening of one unlocked compartment for preventing the opening of any other unlocked compartment, and power-fail safeguard means associated with said interlocking device which lock all of said compartments in event of a power failure, said power-fail safeguard means including an electrical actuator which assumes a first condition when receiving, electrical power and a second condition when not receiving electrical power, and means operatively connected to the interlocking device and responsive to the condition of the actuator for causing the interlocking device to lock all of the compartments when the actuator is in said second condition.

* * * * *